US005654096A

United States Patent [19]

Yamada et al.

[11] Patent Number: 5,654,096

[45] Date of Patent: Aug. 5, 1997

[54] ELECTROCONDUCTIVE CONJUGATE FIBER

[75] Inventors: Hironori Yamada, Osaka; Kimihiro Ogawa, Ibaraki; Seiji Itoh, Matsuyama; Toshihiro Santa, Matsuyama, all of Japan

[73] Assignee: Teijin Limited, Osaka, Japan

[21] Appl. No.: 413,771

[22] Filed: Mar. 30, 1995

[51] Int. Cl.$^6$ ..... D02G 3/00

[52] U.S. Cl. ..... 428/373; 428/372; 428/374; 428/391; 252/518; 252/520

[58] Field of Search ..... 428/372, 373, 428/374, 391, 403, 405, 404; 252/518, 520

[56] References Cited

U.S. PATENT DOCUMENTS 4,420,534 12/1983 Matsui et al. ..... 428/372

FOREIGN PATENT DOCUMENTS 0386256 4/1989 European Pat. Off. .
0343496 5/1989 European Pat. Off. .
0630950 6/1994 European Pat. Off. .
53-92854 8/1978 Japan .
57-6762 1/1982 Japan .
60-110920 6/1985 Japan .
61-20101 4/1986 Japan .
2289109 11/1990 Japan .
2307991 12/1990 Japan .
4153305 5/1992 Japan .
551811 3/1993 Japan .
2077182 6/1981 United Kingdom .

OTHER PUBLICATIONS

Database WPI, Section Ch, Week 8505, Derwent Publications ltd, AN 85–028502 & JP–A–59–223 735 Dec. 1984 Abstract.

*Primary Examiner*—J. M. Gray
*Attorney, Agent, or Firm*—Burgess, Ryan, Wayne

[57] ABSTRACT

An easily producible electroconductive conjugate fiber having an excellent electroconductivity and a high whiteness includes at least one non-electroconductive filamentary segment (A) formed from a fiber-forming polymeric material and at least one electroconductive filamentary segment (B) incorporated with the segments (A) so as to form, for example, a core-in-sheath type or bimetal type conjugate fiber, and including a thermoplastic polymeric matrix (a) and a plurality of electroconductive multilayered particles (b) dispersed in the matrix (a), having an average size of 0.1 to 2.0 μm and each having (i) a core particle of a metal component, (ii) an undercoat layer formed from tin oxides on the core particle and (iii) an uppercoat layer formed from a mixture of indium oxides with tin oxides on the undercoat layer (ii), and optionally surface-treated with a silane compound, for example, vinyl tri-$C_{1-5}$ alkoxysilane, or divinyl di-$C_{1-5}$ alkoxysilane.

22 Claims, No Drawings

ELECTROCONDUCTIVE CONJUGATE FIBER

BACKGROUND OF THE INVENTION

1. Field of the Invention

The present invention relates to an electroconductive conjugate fiber. More particularly, the present invention relates to an electroconductive conjugate fiber having an excellent and durable electroconductivity when practically used, a high whiteness and a superior processability, and capable of being produced with an enhanced and stabilized fiber-formability.

2. Description of the Related Art

It is well known that synthetic fibers, for example, polyester fibers, and polyamide fibers exhibit a poor electroconductivity and thus easily generate static electricity by rubbing them. The static electricity charged on the fibers causes various disadvantages, for example, an undesirable adhesion of dust thereto and electric discharge therefrom.

To remove these disadvantages, there have been many attempts to blend electroconductive fibers comprising a white or colorless electroconductive material contained in a fiber-forming polymeric matrix with the non-electroconductive synthetic fibers. Among them, a noticeable attempt is to utilize electroconductive particles comprising white or colorless fine inorganic particles and electroconductive coating layers formed on the particles and comprising, as a principal component, tin oxides.

For example, Japanese Examined Patent Publication (Kokoku) No. 58-39,175 discloses an antistatic polymer composition comprising a matrix consisting of melt-formable synthetic polymeric material and 3 to 20% by weight of fine titanium dioxide particles surface-coated with tin (IV) dioxide (stannic oxide) and dispersed in the polymeric matrix.

In the tin (IV) dioxide-coated titanium dioxide particles, however, the surface-coating layer formed from the tin (IV) dioxide alone is unsatisfactory in that it cannot fully enhance the electroconductivity of the titanium dioxide particles. Therefore, to obtain synthetic fibers having a satisfactory electroconductivity, a specific doping agent is necessarily added to the tin (IV) dioxide coating layers.

Japanese Examined Patent Publication (Kokoku) Nos. 62-29526 and 1-22,265 and Japanese Unexamined Patent Publication (Kokai) Nos. 2-289,108 and 5-51,811 disclose electroconductive conjugate fibers wherein fine electroconductive particles comprising titanium dioxide core particles and electroconductive coating layers formed on the core particle surfaces and comprising a metal oxide and a doping agent, are dispersed in electroconductive segments of the conjugate fibers. In these publications, the electroconductive coating layers are formed from zinc oxide doped with a doping agent consisting of aluminum oxide, or tin (IV) dioxide doped with a doping agent consisting of antimony oxides. These conventional electroconductive particles are unsatisfactory with respect to the whiteness and electroconductivity of the resultant conjugate fibers. Accordingly, in practical production of synthetic fibers having a satisfactory electroconductivity, sometimes the electroconductive particles are permitted to be decreased in terms of the whiteness thereof.

Japanese Examined Patent Publication No. 62-29526 also discloses electroconductive conjugate fibers formed from a thermoplastic polymeric material containing titanium dioxide particles surface-coated with an electroconductive material and a fiber-forming polymeric material. This Japanese publication states that when the conjugate fibers are heat-treated after a fiber-forming step and a drawing step, the electroconductive structure of the fibers is further developed so as to increase the electroconductivity of the fibers. However, it was found that when the size of the electroconductive particles is made small to enhance he fiber-formability (spinability) of the thermoplastic polymeric material, it is necessary to increase the amount of the particles in the thermoplastic polymeric material to obtain a satisfactory electroconductivity of the particle-dispersed polymeric material, the increased amount of the particle causes the particle-dispersed polymeric material to exhibit an undesirably increased melt viscosity thereof and thus an increased difficulty for the fiber-formation from the polymeric material, and the formation of the electroconductive structure by the electroconductive particles becomes unstable and thus the electroconductive performance of the resultant fibers becomes uneven.

Japanese Unexamined Patent Publication (Kokai) No. 4-153305 discloses an electroconductive fiber containing electroconductive particles made from indium oxides. The concretely disclosed electroconductive particles of the Japanese publication are made from indium oxides doped with a tin oxide doping agent. These particles have a light yellowish color and exhibit a significantly high agglomerating property. Therefore, it is difficult to evenly disperse the electroconductive particles in the thermoplastic polymeric material and to form the material into fibers with a satisfactory process stability.

Japanese Unexamined Patent Publication No. 2-307991 discloses a process for producing electroconductive fibers containing electroconductive metal oxide whiskers in place of the electroconductive particles. The whiskers effectively decrease the necessary amount of the electroconductive material. However, the whiskers are disadvantageous in that when the whiskers are mixed into the polymeric material, air bubbles are easily introduced into the polymeric material, and that it is very difficult to uniformly mix the whiskers into the polymeric material and to form the whisker-containing polymeric material into fibers with a satisfactory process stability.

It is well known that when an inorganic filler is mixed into a polymeric material, the surfaces of the filler particles are treated with a coupling agent to enhance the dispersing property of the filler particles and to improve the adhering property of the filler particles to the polymeric material. However, the inventors of the present invention have found that while the conventional coupling agent is contributory to enhancing the dispersing property of the filler particles and the fiber-forming stability of the filler-containing polymeric material, and the resultant fibers exhibit an unsatisfactory electroconductivity and durability in practical use.

Japanese Unexamined Patent Publication (Kokai) No. 60-110,920 discloses an electroconductive conjugate fiber having an electroconductive segment in which an electroconductive substance comprising a metal oxide core particle and an electroconductive coating layer formed on the core particle surface is dispersed in a thermoplastic polymeric material. This Japanese publication discloses various types of electroconductive particles each having an inorganic core particle made from a member selected from tin oxides, zinc oxide, titanium dioxide, magnesium oxide, silicon oxide, and aluminum oxide, and an electroconductive surface-coating layer formed from a member selected from tin oxides, zinc oxide, copper oxides, indium oxides, zirconium oxides, and tungsten oxides. Also, the Japanese publication teaches to add a small amount of a secondary component to the electroconductive surface-coating layer to enhance the electroconductivity of the surface coating layer. The electroconductive particles concretely disclosed in the Japanese publication consisted of titanium dioxide core particles and electroconductive surface-coating layers formed on the core particles and comprising tin oxides doped with a small amount of antimony oxides. The resultant electroconductive particles have a light bluish grey color close to white. These electroconductive particles are still unsatisfactory to obtain electroconductive fibers having both high whiteness and the satisfactory electroconductivity.

SUMMARY OF THE INVENTION

An object of the present invention is to provide an electroconductive conjugate fiber having a satisfactory whiteness and an excellent electroconductivity.

Another object of the present invention is to provide an electroconductive conjugate fiber having an excellent durability for processing and for practical wearing and capable of being produced with a high fiber-forming stability.

The above-mentioned objects can be attained by the electroconductive conjugate fiber of the present invention comprising;

(A) at least one non-electrocoductive filamentary segment extending along the longitudinal axis of the conjugate fiber and comprising a fiber-forming polymeric material; and (B) at least one electroconductive filamentary segment extending along the longitudinal axis of the conjugate fiber, attached to the non-electroconductive filamentary segment (A) to form a conjugate fiber, and comprising (a) a matrix consisting of a thermoplastic polymeric material and (b) a plurality of electroconductive multilayered solid particles dispersed in the matrix and each comprising:

(i) a core particle comprising a metal compound, (ii) an undercoat layer formed on the peripheral surface of the core particle and consisting essentially of tin oxides, and (iii) an uppercoat layer formed on the undercoat layer and consisting essentially of indium oxides and tin oxides mixed with the indium oxides, said electroconductive particle (b) having an average size of 0.1 to 2.0 μm.

In the electroconductive conjugate fiber of the present invention, preferably the electroconductive multilayered solid particles (b) have a particle size distribution ratio r of 2.0 or less determined by providing particle fractions each having a particle size of a certain value or larger, by a centrifugal precipitation and fractionation method, measuring the cumulative weight and the smallest particle size of the particle fraction, and calculating in accordance with the equation:

$$r=D_{30}/D_{70}$$

wherein $D_{30}$ represents a smallest particle size of a particle fraction having a cumulative weight corresponding to 30% of the total weight of the particles (b), and $D_{70}$ represents a smallest particle size of another particle fraction having a cumulative weight corresponding to 70% of the total weight of the particle (b).

Also, in the electroconductive conjugate fiber of the present invention, preferably the uppercoat layer of the electroconductive multilayered particles is surface treated with a silane compound of the formula:

$$(R^4)_p-Si\leftarrow(R^5)_t-CH=CH_2)_q \quad \text{(II)}$$

wherein $R^4$ represents a member selected from the group consisting of halogen atoms, alkoxyl groups having 1 to 5 carbon atoms and groups of the formula $-OR^6OR^7$ in which $R^6$ represents an alkylene group having 1 to 5 carbon atoms and $R^7$ represents an alkyl group having 1 to 5 carbon atoms, $R^5$ represents a member selected from the group consisting of divalent atoms and groups, p and q respectively and independently from each other represent an integer of 1 to 3 and satisfy the relationship of p+q=4, and t represents zero or an integer of 1.

DESCRIPTION OF THE PREFERRED EMBODIMENTS

The electroconductive conjugate fiber of the present invention comprises (A) at least one non-electroconductive filamentary segment comprising a fiber-forming polymeric material and (B) at least one electroconductive filamentary segment comprising (a) a matrix consisting of a thermoplastic polymeric material and (b) a plurality of electroconductive multilayered particles dispersed in the matrix (a).

Both the non-electroconductive filamentary segment (A) and the electroconductive filamentary segment (B) extend along the longitudinal axis of the conjugate fiber and are incorporated with each other so as to form a conjugate fiber.

The thermoplastic polymeric material for the matrix (a) of the electroconductive filamentary segment (B) is not limited to a specific group of polymeric materials as long as the polymeric material has a thermoplasticity sufficient to form a filamentary segment of the conjugate fiber. Preferably, the thermoplastic polymeric material comprises at least one member selected from the group consisting of polyolefins, for example, polyethylene and polypropylene, polystyrene, diene polymers, for example, polybutadiene and polyisoprene, polyamides, for example, nylon 6 and nylon 66, polyesters, for example, polyethylene terephthalate, polybutylene terephthalate, and copolymers corresponding to the above-mentioned polymers. These polymers and copolymers can be employed alone or in a mixture of two or more thereof.

The electroconductive conjugate fiber of the present invention is characterized by the specific electroconductive solid particles (b) dispersed in a matrix (a) consisting of the electroconductive thermoplastic polymeric material.

The specific electroconductive solid particles (b) have a multilayered structure comprising (i) a core particle comprising a metal compound, (ii) an undercoat layer formed on the peripheral surface of the core particle (i) and consisting essentially of tin oxides, and (iii) an uppercoat layer formed on the undercoat layer (ii) and consisting essentially of indium oxides and tin oxides mixed with each other. The uppercoat layer (iii) has a high electroconductivity.

The metal compound for the core particle (i) is not limited to a specific group of metal compounds as long as the metal compound has a satisfactory whiteness. For example, the metal compound for the core particle (i) is selected from the group consisting of titanium dioxide, aluminum oxide, zinc oxide, silicon dioxide, zinc sulfide, barium sulfate, zirconium phosphate, potassium titanate and silicon oxide-aluminum oxide complexes. Among the above-mentioned metal oxides, titanium dioxide or aluminum oxide, especially aluminum oxide, is most preferable for the present invention because it causes the resultant conjugate fiber to exhibit a satisfactory whiteness and the dispersing property of the resultant multilayered particles in the thermoplastic polymeric material matrix is well balanced with the aggregating property of the resultant multilayered particles so as to cause the electroconductive multilayered particles to form an electroconductive structure in the electroconductive filamentary segment (B). Where aluminum oxide is employed to form the core particle, preferably the aluminum oxide has a degree of purity of 99% or more. If the purity is less than 99%, it becomes difficult to form the tin oxide undercoat layer and then the tin oxides-containing indium oxide uppercoat layer on the aluminum oxide core particle, and thus it becomes difficult to provide the multilayered particles having a satisfactory electroconductivity.

In the electroconductive multilayered particles usable for the present invention, an undercoat layer is formed from tin oxide on the core particle surface. The undercoat layer is preferably present in an amount of 0.5 to 50%, more preferably 1.5 to 40%, based on the weight of the metal compound core particle. If the amount of the undercoat layer is too small, the tin oxides-containing indium oxide uppercoat layer may be formed unevenly and the resultant multilayered particle may exhibit an increased volume resistivity due to the influence of the metal compound core particle. If the amount of the undercoat layer is too large, an amount of a portion of the tin oxide undercoat layer which is not closely adhered to the peripheral surface of the core particle may increase so as to decrease the whiteness and the electroconductivity of the resultant multilayered particle.

The undercoat layer is coated with an uppercoat layer consisting essentially of indium oxides doped with tin oxides. The uppercoat layer is preferably present in an amount of 5 to 200%, more preferably 8 to 150%, based on the weight of the metal compound core particle. Also, in the uppercoat layer, the tin oxides are present in an amount of 0.1 to 20%, more preferably 2.5 to 15%, in terms of tin (IV) dioxide ($SnO_2$), based on the weight of indium oxides.

If the amount of the uppercoat layer is too small, the resultant multilayered particle may exhibit an unsatisfactory electroconductivity. Also, if the amount of the uppercoat layer is too large, the electroconductivity-enhancing effect of the uppercoat layer on the resultant multilayered particle may be saturated and an economical disadvantage may be caused.

Also, the content of tin oxides in the uppercoat layer is preferably controlled to the above-mentioned level. The uppercoat layer preferably has a volume resistivity of 10 Ωcm or less to provide the multilayered particle having a satisfactory electroconductivity.

The electroconductive multilayered particle usable for the present invention can be produced by uniformly coating a peripheral surface of a metal compound core particle with a tin oxide hydrate in an amount of 0.5 to 50%, in terms of $SnO_2$, based on the weight of the core particle, and then the resultant undercoat layer is coated with a mixture of indium oxide hydrate and 0.1 to 20% in terms of $SnO_2$ of tin oxide hydrate, based on the weight of indium oxides dehydrated, in an amount of 5 to 200%, in terms of $In_2O_3$, based on the weight of the core particle, to form an uppercoat layer. Then the resultant multilayered particle is heat-treated in a non-oxidative atmosphere at a temperature of 350° C. to 750° C., to dehydrate the above-mentioned metal oxide hydrates.

The coating layer of the tin oxide hydrate can be formed on the core particles by the following methods.

In one of the methods, an aqueous solution of a tin salt or a stannate is added to an aqueous suspension liquid of metal compound core particles, and then a base (alkali) or acid is added to the resultant mixture.

In another one of the methods, an aqueous solution of a tin salt or a stannate and a base or acid are separately and simultaneously added to an aqueous suspension liquid of metal compound core particles.

To uniformly coat the peripheral surfaces of the metal compound core particles with the tin oxide hydrate, the latter separate-simultaneous adding method is preferable. In this method, the aqueous metal compound core particle suspension liquid is preferably held at a temperature controlled to a level of from 50° C. to 100° C. during the undercoat layer formation. Also, during the simultaneous addition of the aqueous tin salt or stannate solution and the base or acid, the resultant mixture is preferably held at a pH controlled to a level of 2 to 9. Since the isoelectric point of the tin oxide hydrate appears at a pH of 5.5, most preferably the pH of the mixture is controlled to a level of from 2 to 5 or from 6 to 9, so as to allow the resultant hydrolysis product of the tin salt or stannate to uniformly deposit on the peripheral surfaces of the metal compound core particles.

The tin salt usable for the formation of the undercoat layer is preferably selected from stannous and stannic chlorides, stannous and stannic sulfates and stannous and stannic nitrate. Also, the stannate is preferably selected from alkali metal salts of stannic acid, for example, sodium stannate and potassium stannate.

The base is preferably selected from sodium hydroxide and potassium hydroxide, sodium carbonate, potassium carbonate, ammonium carbonate, aqueous ammonia solution and ammonia gas.

The acid is preferably selected from hydrochloric acid, sulfuric acid, nitric acid and acetic acid.

The coating layer of the indium oxide hydrate containing the tin oxide hydrate can be formed on the undercoat layer (tin oxide hydrate-coating layer) by mixing into the aqueous suspension liquid of the tin oxide hydrate-coated core particles, an aqueous solution of an indium salt and a tin salt and simultaneously or subsequently a base. However, to avoid an elution of the tin oxide hydrate layer formed on the core particle, preferably the aqueous solution of the indium salt and the tin salt is added separately from the base, to form a coating layer of the resultant indium oxide hydrate doped with the tin oxide hydrate. In this method, the mixed aqueous suspension liquid is preferably heated at a temperature of 50° C. to 100° C. Also, when the aqueous solution of the indium salt and the tin salt is mixed simultaneously with the base into the aqueous suspension liquid, the pH of the mixed aqueous suspension liquid is preferably held at a pH of 2 to 9, more preferably 2 to 5 or 6 to 9, so as to uniformly deposit the resultant hydrolysis product of the tin salt and indium salt on the tin oxide hydrate-coating layer.

The tin salt for the uppercoat layer is preferably selected from stannous and stannic chlorides, stannous and stannic sulfates and stannous and stannic nitrates. The indium salt is preferably selected from indium chlorides and indium sulfates. The base may be selected from the same bases as those usable for the tin oxide hydrate-coating layer (undercoat layer).

As mentioned above, the tin oxide hydrate-coating layer and the indium oxide hydrate and tin oxide hydrate-coating layer can be dehydrated by the heat-treatment at a temperature of 350° to 750° C. in a non-oxidative atmosphere.

In the formation of the electroconductive filamentary segment (B) in which the electroconductive multilayered particles are dispersed in the thermoplastic polymeric material matrix, it is necessary that the electroconductive multilayered particles are connected to each other so as to form an electroconductive network in the matrix with a high efficiency. For this purpose, the particles should have a certain small size. Nevertheless, if the particle size is too small, the fine particles exhibit an enhanced aggregating property which hinders the formation of the electroconductive network in the matrix and causes the resultant filamentary segment (B) to exhibit an unsatisfactory electroconductivity. Also, the aggregation of the particles in the matrix causes the resultant mixture of the thermoplastic polymeric material with the particle to exhibit a reduced fiber-forming property, and thus when the mixture is subjected to a melt-spinning process, the resultant filaments, are easily broken. Namely, the conjugate fiber becomes difficult to be stably produced.

Also, if the size of the particles is too large, the formation of the electroconductive network by the connection of the particles to each other in the matrix becomes difficult, and thus the resultant filamentary segment (B) exhibits an unsatisfactory electroconductivity.

Accordingly, the average size of the electroconductive multilayered particles is adjusted to a level of 0.1 to 2.0 μm, preferably 0.1 to 1.0 μm.

The aggregating property of the particles is variable depending on the size of the particles. Therefore, if the size of the particles is distributed in a wide range, the particles include a fraction having a high aggregating property and thus become difficult to form a satisfactory electroconductive network in the matrix. Also, the particles having a wide particle size distribution causes frequent breakage of the melt-spin filaments.

Accordingly, the electroconductive multilayered particles (B) preferably have a particle size distribution r of 2.0 or less, more preferably 1.7 or less. The particle size distribution ratio r is defined by the equation:

$$r=D_{30}/D_{70}$$

wherein $D_{30}$ represents a smallest particle size of a particle fraction $F_{30}$ fractionated from the particle (b) by a centrifugal precipitation method and having a cumulative weight $W_{30}$ corresponding to 30% of the total weight of the particle (b), and $D_{70}$ represents a smallest particle size of another particle fraction $F_{70}$ fractionated from the particles (b) by the same method as mentioned above and having a cumulative weight $W_{70}$ of the total weight of the particles (b). In the centrifugal precipitation and fractionation method, the particles successively precipitate from the largest size particles to smaller size particles, and a certain particle fraction F fractionated from the population particles (b) consists of particles having a particle size distributed from a certain smallest size D to the largest size $D_{max}$ and have a cumulative weight W. The particle fraction $F_{30}$ consists of particles having a particle size distributed from $D_{30}$ to the largest size $D_{max}$. Also, the particle fraction $F_{70}$ consists of particles having a particle size distributed from $D_{70}$ to the largest size $D_{max}$.

The particles having a particle size distribution r of 2.0 or less can be provided by subjecting the electroconductive multilayered particles produced by the above-mentioned method to a classification treatment.

The average particle size and the particle size distribution ratio r can be determined by the following measurements.

(1) Average particle size of electroconductive multilayered particles

A sample of the particles is subjected to a centrifugal precipitation and fractionation procedure by using a centrifugal particle size tester (Type: CP-50, made by Shimazu Seisakusho), to provide a centrifugal precipitation curve.

Then, from the centrifugal precipitation curve, a cumulative weight-particle size distribution curve showing a relationship between the particle size of the precipitated particle fraction and a weight ratio of the precipitated particle fraction to the particle sample is prepared, and then from this cumulative weight-particle size distribution curve, a smallest particle size $D_{50}$ of a precipitated particle fraction $D_{50}$ having a cumulative weight $W_{50}$ corresponding to 50% of the total weight of the particle sample is measured, and the average particle size of the particle sample is represented by the measured smallest particle size $D_{50}$.

(2) Particle size distribution ratio r of electroconductive multilayered particles From the above-mentioned cumulative weight-particle size distribution curve of the precipitated particles, a smallest particle size $D_{30}$ of a precipitated particle fraction $F_{30}$ having a cumulative weight $W_{30}$ corresponding to 30% of the total weight of the particle sample and a smallest particle size $D_{70}$ of another precipitated particle fraction $F_{70}$ having a cumulative weight $W_{70}$ corresponding to 70% of the total weight of the particle sample are determined.

The particle size distribution ratio r is calculated in accordance with the equation:

$$r=D_{30}/D_{70}$$

The smaller the value of r, the sharper the particle size distribution of the particles.

In the electroconductive filamentary segment (B), the content of the electroconductive multilayered particles is variable in response to the type, properties and crystallinity of the thermoplastic polymeric material matrix and to the network-forming (chain-forming) property of the electroconductive multilayered particles. Generally, the content of the electroconductive multilayered particles in the segment (B) is preferably 50 to 80% by weight, more preferably 60 to 75% by weight. If the content is less than 50% by weight, while the resultant segment (B) exhibits a satisfactory hue, the electroconductivity of the segment (B) may become unsatisfactory. Also, if the content is more than 80% by weight, it may become difficult to uniformly mix the electroconductive multilayered particles into the thermoplastic polymeric material matrix, and the resultant mixture may exhibit a reduced flow property and a decreased fiber-forming property.

The electroconductive filamentary segment (B) optionally contains an additive selected from coupling agents, dispersing agents, for example, waxes, polyalkylene-oxides, surfactants and organic electrolytes, pigments, stabilizers and a fluidity-enhancing agent.

In the electroconductive conjugate fiber of the present invention, the non-electroconductive filamentary segment (A) is formed from a fiber-forming polymeric material which is not limited to a specific group of polymeric materials as long as the polymeric material has a fiber-forming property sufficient for the production of the conjugate fiber.

The fiber-forming polymeric material for the segment (A) preferably comprises at least one member selected from the group consisting of polyesters, for example, polyethylene terephthalate and polybutylene terephthalate, polyamides, for example, nylon 6 and nylon 66, and polyolefins, for example, polyethylene and polypropylene, and copolymers corresponding to the above-mentioned polymers. These fiber-forming polymeric materials can be formed into fibers by a melt-spinning method. These polymers and copolymers may be employed alone or in a mixture of two or more thereof.

The filamentary segment (A) optionally contains an additive comprising at least one member selected from delusterants, coloring materials, antioxidants, stabilizers, dyeability-enhancing agents, and antistatic agents. The filamentary segment (A) preferably contains the antistatic in a content sufficient to adjust the volume resistivity of the non-electroconductive filamentary segment (A) to a level of $10^8$ to $10^{12}$ Ωcm.

Where the filamentary segment (A) contains the antistatic and exhibits a volume resistivity of $10^8$ to $10^{12}$ Ωcm, preferably the filamentary segment (A) is combined with the filamentary segment (A) to form a core-in-sheath type conjugate fiber in which a core consists of the electroconductive filamentary segment (B) and is covered with a sheath consisting of the non-electroconductive filamentary segment (A). This type of conjugate fiber exhibits an excellent electroconducting performance between fiber surfaces and a high resistance to dust-generation.

The antistatic agent usable for the non-electroconductive filamentary segment (A) may include at least one member selected from the group consisting of polyoxyethylene group-containing polyethers, for example, polyoxyethylene glycol and non-random copolymers having a polyoxyethylene backbone chain and long chain olefin oxide terminal groups attached to the terminals of the backbone chain; polyoxyethylene block copolymers, for example, polyoxyethylene-polyether ester block copolymers and polyoxyethylene-polyether ester amide block copolymers; and organic sulfonic acid salts, for example, alkylbenzene sulfonate and alkylsulfonate.

Preferably, a mixture of the polyoxyethylene polyether with the organic sulfonic acid salt is employed as an antistatic agent for the non-electroconductive filamentary segment (A).

The polyoxyethylene polyether usable as an antistatic agent for the non-electroconductive segment (A) is preferably selected from non-random copolymers having a polyoxyethylene backbone chain and long chain olefin oxide groups attached to the terminals of the backbone chain, and of the formula:

$$Z[(CH_2CH_2O)_m(R^1O)_nR^2]_k \quad (I)$$

wherein Z represents a mono to hexa-valent organic residue derived from organic compounds provided with 1 to 6 active hydrogen atoms and having a molecular weight of 300 or less, $R^1$ represents an alkylene group having 6 to 50 carbon atoms, $R^2$ represents a member selected from the group consisting of a hydrogen atom, monovalent hydrocarbon groups having 1 to 40 carbon atoms and monovalent acyl groups having 2 to 40 carbon atoms, k represents an integer of 1 to 6, m represents an integer causing a product of k and m to be an integer of 70 or more, and n represents an integer of 1 or more. The above-mentioned polyoxyethylene polyether of the formula (I) has at least one hydrophobic block group of the formula $R^1O$, attached to at least one terminal of the polyoxyethylene backbone chain, and thus the antistatic property of the resultant filamentary segment (A) has a high resistance to washing and laundry.

The polyoxyethylene polyether of the formula (I) preferably has an average molecular weight of 5000 to 16000, more preferably 5500 to 14000. If the average molecular weight is less than 5000 or more than 16000, the resultant polyoxyethylene polyether may exhibit a decreased dispersing property in the fiber-forming polymeric material and thus the resultant filamentary segment (A) may exhibit an unsatisfactory antistatic property. The polyoxyethylene polyether of the formula (I) is preferably selected from those disclosed in Japanese Unexamined Patent Publication No. 2-269762, and examples thereof are shown in Table 1.

TABLE 1

| Compound No. | Active hydrogen-containing compound z | Polymerization degree (m) of ethylene oxide (EO) | Type of olefin oxide groups (R'O) | Polymerization degree (n) of (R'O) group | Type of $R^2$ | Average molecular weight |
|---|---|---|---|---|---|---|
| 1 | Ethyleneglycol (k= 2) | 55 | $C_{20}-C_{30}$ α-olefin oxide Average carbon atom number = 23 | 3 | H | 6930 |
| 2 | Ethyleneglycol (k= 2) | 55 | $C_{12}-C_{14}$ α-olefin oxide Average carbon atom number = 13 | 10 | H | 8862 |
| 3 | Ethyleneglycol (k= 2) | 90 | $C_{20}-C_{30}$ α-olefin oxide Average corbon atom number = 23 | 3 | H | 10010 |
| 4 | Bis-phenol (k= 2) | 80 | $C_{12}-C_{14}$ α-olefin oxide Average carbon atom number = 13 | 16 | H | 13604 |
| 5 | Glycerol (k= 3) | 40 | $C_{16}-C_{18}$ α-olefin oxide Average carbon atom number = 17 | 5 | H | 9182 |
| 6 | Pentaerythritol (k= 4) | 40 | $C_{12}-C_{14}$ α-olefin oxide Average carbon atom number = 13 | 5 | H | 11136 |
| 7 | Sorbitol (k= 6) | 30 | $C_{20}-C_{30}$ α-olefin oxide Average carbon atom number = 23 | 2 | H | 12158 |
| 8 | n-Butanol (k= 1) | 80 | Nonene oxide | 30 | H | 7854 |
| 9 | Ethyleneglycol (k= 2) | 55 | $C_{20}-C_{30}$ α-olefin oxide Average carbon atom number = 23 | 3 | $CH_3$ | 6958 |

The polyoxyethylene polyether of the formula (I) is preferably present in a content of 0.5 to 10% by weight, more preferably 1 to 5% by weight, based on the total weight of the non-electroconductive filamentary segment (A). If the content is less than 0.5% by weight, the antistatic property of the conjugate fiber surface may become unsatisfactory. Also, the content of more than 10% by weight may cause the antistatic propery of the resultant filamentary segment to be saturated and the resultant conjugate fiber to exhibit a decreased mechanical property, heat resistance and high resistance.

The organic sulfonic acid salt usable as an antistatic agent for the filamentary segment (A) preferably comprises at least one member selected from the group consisting of alkali metal salts and quaternary phosphonium salts of organic sulfonic acids, for example, sodium, potassium and quaternary phosphonium salts of dodecylbenzenesulfonic acid, tridecylbenzenesulfonic acid, nonylbenzenesulfonic acid, hexadecylsulfonic acids and dodecylsulfonic acid. Among the above-mentioned salts, sodium dodecylbenzenesulfonate and sodium alkylsulfonate mixture having an average carbon atom number of about 14.

The organic sulfonic acid salts can be empolyed alone or in a mixture of two or more of the organic sulfonic acid salts. Preferably, the organic sulfonic acid salt is present in an amount of 0.1 to 5% by weight, more preferably 0.1 to 3% by weight, based on the total weight of the non-electroconductive filamentary segment (A). If the amount is less than 0.1% by weight, the resultant filamentary segment (A) may exhibit an unsatisfactory antistatic property and a high volume resistivity. Also, if the amount of the organic sulfonic acid salt is more than 5% by weight, the resultant mixture of the fiber-forming polymeric material with the organic sulfonic acid salt may exhibit a reduced fiber-forming property and the resultant conjugate fiber may have an unsatisfactory mechanical property.

In another embodiment of the electroconductive conjugate fiber of the present invention, the uppercoat layer (iii) of each electroconductive multilayered particle (b) is surface-treated with a silane compound of the formula (II):

$$(R^4)_p-si-(R^5)_t-CH=CH_2)_q \qquad (II)$$

wherein $R^4$ represents a member selected from the group consisting of halogen atoms, alkoxyl groups having 1 to 5 carbon atoms and groups of the formula, $-OR^6OR^7$ in which $R^6$ represents an alkylene group having 1 to 5 carbon atoms and $R^7$ represents an alkyl group having 1 to 5 carbon atoms, $R^5$ represents a member selected from the group consisting of divalent atoms and groups, p and q respectively and independently from each other represent an integer of 1 to 3 and satisfy the relationship of p+q=4, and t represents zero or 1.

In the formula (II), the divalent atoms and groups represented by $R^5$ are preferably selected from the group consisting of —O—, $-CH_2-$, $-CH_2CH_2-$, and $$-\underset{\underset{O}{\|}}{C}-O-.$$

The divalent atom or group $R^5$ may be not included in the silane compound of the formula (II). Where two or more atoms or groups represented by $R^4$ are contained in the silane compound, they may be the same as or different from each other.

The silane compound of the formula (II) is preferably selected from the group consisting of vinyl trimethoxysilane, vinyl triethoxysilane, vinyl trichlorosilane, divinyl dimethoxysilane, divinyl diethoxysilane divinyl dichlorosilane.

The silane compound of the formula (II) coated on the uppercoat layer of the electroconductive multilayer particle advantageously enhances the electroconductivity and the dispersing property of the particles in the thermoplastic polymeric material, the fiber-forming property (melt-spinnability) of the mixture of the thermoplastic polymeric material with the electroconductive multilayered particles for the electroconductive filamentary segment (B), and the durability in electroconductivity of the resultant conjugate fiber.

The electroconductive multilayered particles to be surface treated with the silane compound of the formula (II) preferably has a specific resistivity of $10^4$ Ωcm or less. The specific resistivity can be determined by packing a cylinder having an inside diameter of 1 cm with 10 g of the electroconductive particles, compress-molding the particles by using a compressing piston under a pressure of 200 kg to provide a specimen, and applying a direct current to the specimen at a voltage of 1000 V.

The surface treatment of the uppercoat layer of the electroconductive multilayered particle with the silane compound of the formula (II) can be effected by a usual particle surface-treating method. For example, a solution of the silane compound is sprayed onto the particles while agitating. Alternatively, the particles are dispersed in a solvent, for example, an organic solvent, to prepare a slurry, a solution of the silane compound is mixed into the particle slurry while agitating, and then the liquid component is removed from the mixture and the remaining surface-treated particles are dried.

The resultant surface-treated particle preferably contains the silane compound in an amount of 0.1 to 10% based on the weight of the core particle.

The electroconductive conjugate fiber of the present invention is not limited to those having a specific conjugation structure. Namely, the conjugate fiber of the present invention may have a bi-metal (side-by-side) structure, a core-in-sheath structure, a sandwich structure, a multi-circular triangle structure, a multi-core-in-sheath structure and a multi-layer structure. The conjugate fiber may have any cross-sectional profile, for example, a circular cross-sectional profile or an irregular cross-sectional profile.

The non-electroconductive and electroconductive filamentary segments (A) and (B) may have any cross-sectional profile. There is no limitation to the numbers of the non-electroconductive and electroconductive filamentary segments (A) and (B).

Preferably the conjugate fiber of the present invention has a core-in-sheath structure composed of a core consisting of the electroconductive filamentary segment (B) and a sheath consisting of the electroconductive filamentary segment (A) and covering the core. Also, the non-electroconductive filamentary segment (A) preferably contains the antistatic agent so as to enhance the antistatic property and the electroconductivity of the resultant conjugate fiber.

The proportions in weight or cross-sectional area of the non-electroconductive and electroconductive filamentary segments (A) and (B) can be varied in a wide range. However, if the proportion of the electroconductive filamentary segment (B) is too high, the resultant conjugate fiber exhibits a reduced mechanical strength. Accordingly, the electroconductive filamentary segment or segments (B) preferably have a total cross-sectional area corresponding to 50% or less but not less than 1%, more preferably 3 to 50%, of the total cross-sectional area of the composite fiber. Also, it is important that the non-electroconductive filamentary segment (A) and the electroconductive filamentary segment (B) be continuously incorporated into each other along the longitudinal axis of the conjugate fiber.

The electroconductive conjugate fiber of the present invention can be produced from a fiber-forming polymeric material for the non-electroconductive filamentary segment (A) and a mixture of a thermoplastic polymeric material and electroconductive multilayered particles by any conjugate fiber-forming method. Also, the conjugate fiber can be drawn by any drawing method.

In the electroconductive conjugate fiber of the present invention, the specific electroconductive multilayered particles have an enhanced whiteness, are capable of being uniformly dispersed in the polymeric material and of appropriately aggregating with each other to form, in the resultant electroconductive filamentary segment (B), an electroconductive continuous network extending along the longitudinal axis of the conjugate fiber. Therefore, the conjugate fiber of the present invention exhibits an enhanced whiteness, an excellent electroconductivity and a satisfactory processability.

The conjugate fiber of the present invention is useful for the production of white or lightly colored fiber products having a high electroconductivity. The conjugate fibers of the present invention can be easily blended with other fibers and impart a high electroconductivity to the resultant fiber blend products, without degrading the whiteness and appearance of the products.

When the conjugate fiber has a core-in-sheath structure having a non-electroconductive sheath layer, the antistatic property of the conjugate fiber can be enhanced by adding an antistatic agent to the sheath layer so as to adjust the volume resistivity of the sheath layer to a level of $10^8$ to $10^{12}$ Ωcm.

The antistatic sheath layer effectively enhances the electroconductivity of the conjugate fiber, reduces a friction of the fiber with another fiber, and thus presents breakage and fibrillation of the fiber and generation of fibrous dust.

Also, the utilization of the silane compound effectively enhances the electroconductivity and dispersing property of the electroconductive multilayered particles.

EXAMPLES

The present invention will be further explained by the following examples.

In the examples, the following measurements were carried out.

(1) Measurements of volume resistivity (Ωcm) of electroconductive particles and non-electroconductive filamentary segment (A)

Electroconductive particles in an amount of 10 g were packed in a cylinder having an inside diameter of 1 cm and compress-molded by compressing the particles through the upper opening of the cylinder by a piston under a pressure of 200 kg. A direct current was applied to the compress-molded particles under a voltage of 1 kV to measure a volume resistivity of the particles.

The volume resistivity of a non-electroconductive filamentary segment (A) was determined by producing a filament yarn having a yarn count of 33 d tex/3 filaments from the polymeric material alone for the segment (A), measuring the cross-section resistivity of 100 filaments at a temperature of 20° C. at a relative humidity of 40%, and calculating the volume resistivity of the filaments from the measured cross-section resistivity data.

(2) Measurement of hue of electroconductive multilayered particles

The L value (brightness index) and b value (chromaticity index) of the particles in the form of powder were measured by using a Hunter color difference meter.

(3) Measurements of average particle size and particle distribution ratio r

A sample of particles was subjected to a centrifugal precipitation and fractionation by using a centrifugal particle size tester to provide a centrifugal precipitation curve, a cumulative weight-particle size distribution curve showing a relationship between the particle size of the precipitated particle fraction and the weight ratio of the precipitated particle fraction to all the particles was prepared from the centrifugal precipitation curve.

From this cumulative weight-particle size distribution curve, a smallest particle size $D_{50}$ of a precipitated particle fraction $F_{50}$ having a cumulate weight $W_{50}$ corresponding to 50% of the total weight of the particles was determined.

The average particle size of the particles is represented by the determined smallest particle size $D_{50}$.

Also, the particle size distribution ratio r was calculated from the cumulative weight-particle size distribution curve in accordance with the equation:

$$r=D_{30}/D_{70}$$

wherein $D_{30}$ represents a smallest particle size of a precipitated particle fraction $F_{30}$ having a cumulative weight $W_{30}$ corresponding to 30% of the total weight of the particles, and $D_{70}$ represents a smallest particle size of a precipitated particle fraction $F_{70}$ having a cumulative weight $W_{70}$ corresponding to 70% of the total weight of the particles.

(4) Measurement of cross-section resistivity in units of Ω/cm

The terms "cross-section resistivity" of a fiber refers to a resistivity between a pair of cross-sections of the fiber spaced 1 cm from each other.

The measurement of the cross-section resistivity was carried out by cutting an individual fiber to a length of 1 cm, placing the cut fiber on a polytetrafluoroethylene film, coating the cut end faces of the fiber with an electroconductive paint (available under the trademark of DOTITE, from Fujikura Kasei K.K.) and measuring the electroresistivity between the cut end faces of the fiber by using a resistivity tester under a voltage of 1 kV. The measurement was carried out at a temperature of 20° C. at a relative humidity (RH) of 30%.

(5) Measurement of surface resistivity in Ω/cm of the conjugate fiber

The term "surface resistivity" of the fiber means an electroresistivity between two points on the surface of the fiber and spaced 1 cm from each other. The measurement was carried out by bringing two detection terminals of the resistivity tester into direct contact with two points on the fiber surface spaced 1 cm from each other, applying a direct current between the two points at a voltage of 1 kV and measuring the resistivity between the two points. The measurement was carried out at a temperature of 20° C. at a relative humidity (RH) of 30%.

(6) Static charge

The static charge was measured in accordance with a frictional static charge measurement method of JIS L 1094.

According to Static Charge Safety Guideline published by the Industrial Safety Research Institute, Ministry of Labor, the safe frictional static charge must be a standard value of 7 μC/m² or less.

(7) Fiber-formability

A continuous melt spinning process was carried out for 24 hours, and the number of breakages of the filament yarns per day was counted. The fiber-formability was classified into three classes as follow

| Class | The number of filament yarn breakages per day |
|---|---|
| 5 | 0 to 3 |
| 4 | 4 to 6 |
| 3 | 7 to 10 |
| 2 | 11 to 14 |
| 1 | 15 or more |

(8) Durability test

Conjugate fiber yarns to be tested were covered with spun yarns of a blend of polyethylene terephthalate fibers with cotton fibers in a blend weight ratio of 65:35.

A 2/1 twill weave was produced from warp yarns consisting of spun yarns of a blend of polyethylene terephthalate fibers with cotton fibers in a blend weight ratio of 65:35 and having a cotton yarn count of 20s and the above-mentioned spun yarn-covered conjugate fiber yarns arranged at intervals of 80 spun yarns, and weft yarns consisting of the spun yarns at a warp density of 80 yarns/25.4 mm and a weft density of 50 yarns/25.4 mm.

The twill weave was scoured, dyed and finished in the same manner as that for the usual polyester fiber-cotton blend yarn woven fabrics.

The finished twill weave was repeatedly laundered 200 times under usual commercial laundry conditions. From the laundered fabric, the electroconductive conjugate fibers were collected. The collected conjugate fibers were subjected to measurements of the cross-section resistivity and the static charge.

Example 1

(1) Preparation of electroconductive multilayered particles

An aqueous suspension was prepared by dispersing 100 g of rutile titanium dioxide (available under the trademark of KR-310, from Chitan Kogyo K.K.) in 1000 ml of water and heated and held at a temperature of 70° C.

Separately, a solution was prepared by dissolving 11.6 g of stannic chloride ($SnCl_4.5H_2O$) in 100 ml of 2N-hydrochloric acid solution.

The stannic chloride solution and a 12% by weight ammonia aqueous solution were mixed into the titanium dichloride suspension over a time of about 40 minutes while maintaining the pH of the resultant mixture at a level of 7 to 8.

To the resultant suspension, a solution of 36.7 g of indium trichloride ($InCl_3$) and 5.4 g of stannic chloride ($SnCl_4.5H_2O$) in 450 ml of a 2N-hydrochloric acid solution and a 12% by weight ammonia aqueous solution were simultaneously added dropwise over a time of about one hour, while maintaining the pH of the resultant mixture at a level of 7 to 8. After the completion of the dropwise addition, the resultant suspension was filtered, the filtrate was washed with water, and the resultant multilayered particle cake was dried at a temperature of 110° C. The dried multilayered particles were heat treated in a nitrogen gas stream flowing at a flow rate of one liter/min, at a temperature of 500° C. for one hour, to prepare electroconductive multilayered particles. The particles were classified by a dry classifying method. The classified particles had an average particle size of 0.43 μm, a particle size distribution ratio r of 1.32, a volume resistivity of 3.8 Ωcm, a L value of 97 and a b value of 3.5, as indicated in Table 2.

(2) Preparation of polyethylene terephthalate resin composition

A polyethylene terephthalate resin composition was prepared as follows.

An ester-exchange reactor was charged with 100 parts by weight of dimethyl terephthalate, 60 parts by weight of ethyleneglycol, 0.06 part by weight of calcium acetate monohydrate (corresponding to 0.066 molar % based on the molar amount of dimethyl terephthalate) and a color adjuster consisting of 0.009 part by weight of cobalt acetate tetrahydrate (corresponding to 0.007 molar % based on the molar amount of dimethyl terephthalate), the temperature of the resultant reaction mixture was raised from 140° C. to 220° C. over a period of 4 hours in a nitrogen gas atmosphere to effect an ester-exchange reaction, while distilling away methyl alcohol produced from the ester-exchange reaction.

After the completion of the ester-exchange reaction, to the resultant reaction product mixture, a stabilizer consisting of 0.058 part by weight of trimethyl phosphate (corresponding to 0.080 molar % based on the molar amount of dimethyl terephthalate) and a defoamer consisting of 0.024 part by weight of dimethyl polysiloxane were added. Ten minutes after the addition, to the resultant reaction mixture, 0.04 part by weight of antimony trioxide (corresponding to 0.027 molar % based on the molar amount of dimethyl terephthalate) was further added, and immediately the temperature of the reaction mixture was raised to 240° C. while removing an excess amount of ethylene glycol. Then, the heated reaction mixture was moved to a polymerization reactor. The pressure in the polymerization reactor was reduced from 760 mmHg to 1 mmHg over a period of one hour, while the temperature of the reaction mixture was raised from 240° C. to 285° C. over a period of 90 minutes.

The polymerization was further continued for one hour under a reduced pressure of 1 mmHg, then an antioxidant consisting of 0.1 part by weight of SYANOX 1990 (trademark, made by American CYANAMID Co.) and 0.3 part by weight of Mark AO-412S (trademark, made by Adeca Argus Chemical Co.) was added to the reaction mixture under the reduced pressure. The polymerization was further continued for 20 minutes. A polyester resin composition having an intrinsic viscosity of from 0.640 to 0.660 and a softening temperature of 261.5° to 263° C. was obtained.

The polyester resin composition was pelletized. The polyester resin composition had the volume resistivity of $1\times10^{14}$ Ωcm as indicated in Table 3.

(3) Production of electroconductive conjugate filaments

A polymeric material mixture for an electroconductive filamentary segment (A) was prepared by fully knead-mixing 250 parts by weight of the electroconductive multilayered particles with 100 parts by weight of a polyethylene resin in a kneader.

A polymeric material mixture for a non-electroconductive filamentary segment (A) was prepared by mixing 2.5% by weight of titanium dioxide into the polyester resin composition.

Core-in-sheath type conjugate filaments were produced by using a core-in-sheath type conjugate filament-spinning machine, from the electroconductive multilayered particle-containing polyethylene resin mixture from which cores of the conjugate filaments were formed, and the titanium dioxide-containing polyester resin mixture from which sheaths of the conjugate filaments were formed.

The conjugate filaments were drawn at a temperature of 100° C. at a draw ratio of 4, and then heat-set at a temperature of 160° C.

The resultant conjugate filament had a ratio in cross-sectional area of the cores to the sheaths of 1:6 and a yarn count of 66.7 d tex/3 filaments.

The properties of the conjugate filaments are shown in Table 2.

Examples 2 to 6

In each of Examples 2 to 6, core-in-sheath type conjugate filaments were produced by the same procedures as in Example 1 with the following exceptions.

The electroconductive multilayered particles had the average particle size, particle size distribution ratio r, volume resistivity, L value and b value as shown in Table 2.

The properties of the resultant conjugate filaments are shown in Table 2.

Comparative Example 1

In Comparative Example 1, core-in-sheath type conjugate filaments were produced by the same procedures as in Example 1, except that the electroconductive multilayered particles had the average particle size, particle size distribution ratio r, volume resistivity, L value and b value as shown in Table 2.

The properties of the conjugate filaments are shown in Table 2.

Example 7

The same procedures as in Example 1 were carried out with the following exceptions.

The electroconductive multilayered particles included cores consisting of aluminum oxide having a degree of purity of 99.9%, in place of the titanium dioxide cores, and had the average particle size, particle size distribution ratio r, volume resistivity, L value and b value as shown in Table 2.

The resultant conjugate filaments had the properties shown in Table 2.

Comparative Example 2

The same procedures as in Example 1 were carried out except that the electroconductive multilayered particles were composed of titanium dioxide cores and coating layers formed on the cores and consisting of tin oxides doped with antimony oxide, and had the average particle size, particle size distribution ratio r, volume resistivity, L value and b value as shown in Table 2.

The resultant conjugate filaments had the properties as shown in Table 2.

The electroconductive multilayered particles contained the type of core particles shown in Table 3 and had the amount of the uppercoat layer and the average particle size, particle size distribution ratio r, volume resistivity, L value and b value as shown in Table 3.

In the preparation of the polyester resin composition, 2 hours after the start of the pressure reduction in the polymerization step, a polyoxyethylene polyether of the formula:

$$HO\left(\underset{\substack{|\\ C_jH_{2j+1}}}{CHCH_2O}\right)_{n'}\left(CH_2CH_2O\right)_{m'}\left(\underset{\substack{|\\ C_jH_{2j+1}}}{CH_2CHO}\right)_{n'}H$$

wherein j represents an integer of 18 to 28, the average value of j is 21, m' represents about 115 in average and n' represents 3 in average, and having an average molecular weight of 7106, and in the amount shown in Table 3, and a solution of 5% by weight of sodium dodecylbenzenesulfonate in ethyleneglycol in the amount shown in Table 3, were added to the polymerization mixture.

The resultant polyester resin composition had the volume resistivity as shown in Table 3.

TABLE 2

| Item | | Electroconductive multilayered particle | | | | | | Filament | |
|---|---|---|---|---|---|---|---|---|---|
| | | Average particle size | Particle size distribution ratio | Volume resistivity | Color difference | | Fiber-forma- | | Cross-section resistivity |
| Example No. | | (μm) | (r) | (Ωcm) | L value | b value | bility | Whiteness | (Ω/cm) |
| Example | 1 | 0.43 | 1.32 | 3.8 | 97 | 3.5 | 3 | Good | $3.9 \times 10^8$ |
| | 2 | 0.32 | 1.62 | 3.9 | 96 | 3.4 | 3 | Good | $4.2 \times 10^8$ |
| | 3 | 0.83 | 1.43 | 5.9 | 97 | 3.5 | 3 | Good | $5.0 \times 10^8$ |
| | 4 | 0.53 | 1.90 | 7.6 | 98 | 3.2 | 3 | Good | $5.3 \times 10^8$ |
| Comparative Example | 1 | 0.08 | 1.70 | 2.6 | 98 | 3.1 | 1 | Good | $7.8 \times 10^{10}$ |
| Example | 5 | 0.11 | 1.72 | 3.2 | 98 | 3.2 | 3 | Good | $5.3 \times 10^8$ |
| | 6 | 0.95 | 1.92 | 5.2 | 97 | 3.6 | 3 | Good | $3.9 \times 10^8$ |
| | 7 | 0.45 | 1.42 | 5.2 | 88 | 3.2 | 3 | Excellent | $3.9 \times 10^8$ |
| Comparative Example | 2 | 0.51 | 1.70 | 8.3 | 83 | 1.3 | 3 | Bad | $5.0 \times 10^9$ |

Examples 8 to 17

In each of Examples 8 to 17, core-in-sheath type conjugate filaments were produced by the same procedures as in Example 1 with the following exceptions.

The resultant conjugate filaments had the properties as shown in Table 3.

Table 3 also shows the test results of Example 1.

TABLE 3

| Example No. | Electo conductive multilayered particle: Core particle | Uppercoat layer (wt %) | Particle: Average particle size (μm) | size distribution ratio r | Volume resistivity (Ωcm) | Colore difference L | b | Non-electro conductive segment (A) Content: Content of polyether (wt %) | Content of organic sulfonic acid salt (wt %) | Volume resistivity (Ωcm) | Fiber-formability | Filament: Whiteness | Cross-section resistivity (Ω/cm) | Surface resistivity (Ω/cm) |
|---|---|---|---|---|---|---|---|---|---|---|---|---|---|---|
| Example 1 | $TiO_2$ Rutile | 22 | 0.43 | 1.32 | 2.4 | 95 | 4.4 | 0 | 0 | $1 \times 10^{14}$ | 3 | good | $3.9 \times 10^8$ | $7.4 \times 10^{12}$ |
| Example 8 | $TiO_2$ Rutile | " | " | " | " | " | " | 0.6 | 0.8 | $1 \times 10^{12}$ | 3 | good | $3.7 \times 10^8$ | $2.4 \times 10^{11}$ |
| Example 9 | $TiO_2$ Rutile | " | " | " | " | " | " | 1.4 | 0.8 | $5 \times 10^{10}$ | 3 | good | $3.5 \times 10^8$ | $2.0 \times 10^{10}$ |
| Example 10 | $TiO_2$ Rutile | " | " | " | " | " | " | 4.0 | 0.8 | $7 \times 10^9$ | 3 | good | $3.2 \times 10^8$ | $1.3 \times 10^{10}$ |
| Example 11 | $TiO_2$ Rutile | " | " | " | " | " | " | 7.0 | 0.8 | $5 \times 10^8$ | 3 | good | $3.2 \times 10^8$ | $9.5 \times 10^{10}$ |
| Example 12 | $TiO_2$ Rutile | " | " | " | " | " | " | 2.0 | 0.2 | $1 \times 10^{11}$ | 3 | good | $3.4 \times 10^8$ | $2.1 \times 10^{11}$ |
| Example 13 | $TiO_2$ Rutile | " | " | " | " | " | " | 2.0 | 3.0 | $1 \times 10^{10}$ | 3 | good | $3.3 \times 10^8$ | $1.6 \times 10^{11}$ |
| Example 14 | $TiO_2$ Anatase | " | 0.38 | 1.78 | 3.1 | 96 | 3.2 | 1.4 | 1.0 | $5 \times 10^{10}$ | 3 | good | $4.1 \times 10^8$ | $2.3 \times 10^{11}$ |
| Example 15 | $Al_2O_3$ | " | 0.42 | 1.42 | 3.9 | 88 | 4.1 | 1.4 | 1.0 | $5 \times 10^{10}$ | 3 | good | $4.5 \times 10^8$ | $2.8 \times 10^{11}$ |
| Example 16 | $Al_2O_3$ | 9 | 0.45 | 1.45 | 8.7 | 87 | 3.7 | 1.4 | 1.0 | $5 \times 10^{10}$ | 3 | good | $4.8 \times 10^8$ | $3.1 \times 10^{11}$ |
| Example 17 | $SiO_2$ | 22 | 0.25 | 1.35 | 2.5 | 95 | 2.4 | 1.4 | 1.0 | $5 \times 10^{10}$ | 3 | good | $3.8 \times 10^8$ | $2.5 \times 10^{11}$ |

Examples 18 and 19

In each of Examples 18 and 19, the same procedures as in Example 8 were carried out except that the polyoxyethylene polyether was replaced by 4 parts by weight of a polyethyleneglycol having an average molecular weight of 20,000, and the sodium dodecylbenzenesulfonate was replaced by 2% by weight of sodium dodecylsulfonate. The resultant polyethylene terephthalate resin composition had a volume resistivity of $1 \times 10^{10}$ Ωcm. Also, the content of the electroconductive multilayered particles in the polyethylene resin mixture for the filamentary segment (B) was as indicated in Table 4.

The test results are shown in Table 4.

TABLE 4

| Item Example No. | | Content of electro-conductive particles (wt %) | Fiber-form-ability | Filament: Whiteness | Cross-section resistivity (Ωcm) | Surface resistivity (Ωcm) |
|---|---|---|---|---|---|---|
| Example | 18 | 65 | 3 | Good | $5.2 \times 10^8$ | $5.9 \times 10^{11}$ |
| | 19 | 75 | 3 | Good | $3.1 \times 10^8$ | $3.9 \times 10^{11}$ |

Example 20

(1) Preparation of electroconductive multilayered particles

Electroconductive multilayered particles were prepared by coating surfaces of aluminum oxide core particles having an average particle size of 0.35 μm with tin oxide to form undercoat layers in an amount of 10 parts by weight per 100 parts by weight of aluminum oxide core particles, and then further coating the undercoat layer surfaces with indium oxides doped with tin oxides to form uppercoat layers in an amount of 20 parts by weight per 100 parts by weight of the aluminum oxide core particles and containing 8 parts by weight of tin oxides. The resultant multilayered particles had an average particle size of 0.39 μm and exhibited a specific resistivity of 6.0 μcm.

The multilayered particles in an amount of 100 parts by weight and in the form of a powder were mixed with 2 parts by weight of vinyl trimethoxysilane at room temperature over a period of 10 minutes while agitating the mixture. The mixture was further agitated for 60 minutes. After the completion of the agitation, the mixture was dried at a temperature of 80° C. for 120 minutes, to provide surface treated, multilayered particles.

(2) Production of electroconductive conjugate filaments

A resin mixture consisting of 100 parts by weight of polyethylene (trademark: SUMIKASEN G-807, made by Sumitomo Kagaku) and 250 parts by weight of the surface-treated electroconductive multilayered particles was melted at a temperature of 180° C.

Also, a polyester resin mixture consisting of polyethylene terephthalate and 2.5% by weight of titanium dioxide was melted at a temperature of 300° C.

Core-in-sheath type conjugate filaments were produced by using concentric core-in-sheath type conjugate filament-forming machine from the polyethylene-electroconductive particle mixture melt from which cores of the conjugate filaments were formed, and the polyester resin mixture melt from which sheaths of the conjugate filaments were formed. The melt-spinning nozzles of the fiber-forming machine was kept at a temperature of 285° C., and the resultant conjugate filaments were taken up at a speed of 630 m/min. The resultant undrawn conjugate filaments had a cross-sectional area ratio of the core segments to the sheath segments of 1:6. The undrawn conjugate filaments were drawn at a temperature of 130° C. at a draw ratio of 4, and heat-set at a temperature of 160° C.

The resultant drawn conjugate filament yarn had a yarn count of 33.3 dtex/3 filaments.

The test results are shown in Table 5.

Examples 21 to 25

In each of Examples 21 to 25, the same procedures as in Example 20 were carried out except that the electroconductive multilayered particles were surface-treated with the silane compound as shown in Table 5 in place of vinyl trimetoxysilane.

The test results are shown in Table 5.

TABLE 5

| Item Example No. | Silane compound | Electroconductivity: Cross-section resistivity (Ω/cm) Before durability test × $10^8$ | After durability test × $10^8$ | Static charge (μc/m²) Before durability test | After durability test | Fiber-form-ablity |
|---|---|---|---|---|---|---|
| Example | | | | | | |
| 20 | Vinyl methoxysilane | 2.5 | 3.5 | 2.0 | 3.0 | 5 |
| 21 | Vinyl ethoxysilane | 2.8 | 4.0 | 2.5 | 3.5 | 5 |
| 22 | Vinyl chlorosilane | 2.5 | 4.0 | 2.0 | 3.5 | 5 |
| 23 | None | 3.9 | 4.7 | 4.0 | 4.5 | 3 |
| 24 | γ-aminopropyltri-ethoxy-silane | 8.0 | 11.0 | 5.0 | 7.0 | 4 |
| 25 | (N-(β-aminomethyl)- γ-amino propylmethyl-dimethoxysilane | 9.0 | 12.0 | 6.0 | 7.5 | 5 |

Examples 26 to 29

In each of Examples 26 to 29, the same procedures as in Example 20 were carried out except that in the electroconductive multilayered particles, the aluminum oxide core particles were replaced by titanium dioxide core particles having an average particle size of 0.35 μm, and the resultant particles had an average particle size of 0.43 μm and exhibited a specific resistivity of 6.2 Ωcm. Also, the resultant multilayered particles were surface-treated with the silane compound shown in Table 6.

The test results are shown in Table 6.

TABLE 6

| Item Example No. | Silane compound | Electroconductivity: Cross-section resistivity (Ω/cm) Before durability test × $10^8$ | After durability test × $10^8$ | Static charge (μc/m²) Before durability test | After durability test | Fiber-form-ability |
|---|---|---|---|---|---|---|
| Example | | | | | | |
| 26 | Vinyl trimethoxysilane | 3.0 | 3.5 | 2.5 | 3.0 | 5 |
| 27 | Vinyl triethoxysilane | 3.0 | 4.0 | 2.5 | 3.5 | 5 |
| 28 | Vinyl tri(β-methoxyethoxy) silane | 2.5 | 3.5 | 2.0 | 3.0 | 5 |
| 29 | None | 3.9 | 5.8 | 4.5 | 5.0 | 3 |

We claim:

1. An electroconductive conjugate fiber comprising:

(A) at least one non-electroconductive filamentary segment extending along the longitudinal axis of the conjugate fiber and comprising a fiber-forming polymeric material; and (B) at least one electroconductive filamentary segment extending along the longitudinal axis of the conjugate fiber, attached to the non-electroconductive filamentary segment (A) to form a conjugate fiber, and comprising (a) a matrix consisting of a thermoplastic polymeric material and (b) a plurality of electroconductive multilayered solid particles dispersed in the matrix and each comprising:

(i) a core particle comprising a metal compound selected from the group consisting of titanium dioxide, aluminum oxide, zinc oxide, silicon dioxide, zinc sulfide, barium sulfate, zirconium phosphate, potassium titanate and silicon oxide-aluminum oxide complexes, (ii) an undercoat layer formed on the peripheral surface of the core particle and consisting essentially of tin oxides, (iii) an uppercoat layer formed on the undercoat layer and consisting essentially of indium oxides doped with tin oxides, (iv) a surface-treating layer formed by surface-treating the uppercoat layer (iii) with a silane compound of the formula (II):

$$(R^4)_p—Si—((R^5)_t—CH=CH_2)_q \quad (II)$$

wherein $R^4$ represents a member selected from the group consisting of halogen atoms, alkoxyl groups having 1 to 5 carbon atoms and groups of the formula $—OR^6OR^7$ in which $R^6$ represents an alkylene group having 1 to 5 carbon atoms and $R^7$ represents an alkyl group having 1 to 5 carbon atoms, $R^5$ represents a member selected from the group consisting of divalent atoms and groups, p and q respectively and independently from each other represent an integer of 1 to 3 and satisfy the relationship of p+q=4, and t represents zero or 1, said electroconductive particles (b) having an average particle size of 0.1 to 2.0 μm.

2. The electroconductive conjugate fiber as claimed in claim 1, wherein the electroconductive multilayered particles (b) have a particle size distribution ratio r of 2.0 or less, determined by subjecting the particles (b) to a centrifugal precipitation and fractionation to provide a precipitated particle fraction, measuring the cumulative weight and the smallest particle size of the precipitated particle fraction, and calculating in accordance with the equation:

$$r=D_{30}/D_{70}$$

wherein $D_{30}$ represents a smallest particle size of a precipitated particle fraction having a cumulative weight corresponding to 30% of the total weight of the particles (b), and $D_{70}$ represent a smallest particle size of a precipitated particle fraction having a cumulative weight corresponding to 70% of the total weight of the particles (b).

3. The electroconductive conjugate fiber as claimed in claim 1, wherein the electroconductive multilayered particles (b) are present in an amount of 50 to 80% by weight, based on the total weight of the electroconductive filamentary segment (B).

4. The electroconductive conjugate fiber as claimed in claim 1, wherein the electroconductive filamentary segment (B) has a cross-sectional area corresponding to 1% to 50% of the total cross-sectional area of the conjugate fiber.

5. The electroconductive conjugate fiber as claimed in claim 1, wherein the metal compound for the core particle of each electroconductive multilayered particle is aluminum oxides.

6. The electroconductive conjugate fiber as claimed in claim 1, wherein the undercoat layer is present in an amount of 0.5 to 50% by weight based on the weight of the core particle.

7. The electroconductive conjugate fiber as claimed in claim 1, wherein the uppercoat layer is present in an amount of 5 to 200% by weight based on the weight of the core particle.

8. The electroconductive conjugate fiber as claimed in claim 1, wherein the tin oxides contained in the uppercoat layer iii, are present in an amount of 0.1 to 20% by weight, calculated as tin (IV) dioxide, based on the weight of the indium oxide.

9. The electroconductive conjugate fiber as claimed in claim 1, wherein the thermoplastic polymeric material for the electroconductive filamentary segment (B) comprises at least one member selected from the group consisting of polyolefins, polystyrene, diene polymers, polyamides, polyesters and copolymers corresponding to the above-mentioned polymers.

10. The electroconductive conjugate fiber as claimed in claim 1, wherein the fiber-forming polymeric material for the non-electroconductive filamentary segment (A) comprises at least one member selected from the group consisting of polyesters, polyamides, polyolefins and copolymers corresponding to the above-mentioned polymers.

11. The electroconductive conjugate fiber as claimed in claim 1, wherein the non-electroconductive filamentary segment (A) contains an antistatic agent mixed in the fiber-forming polymeric material.

12. The electroconductive conjugate fiber as claimed in claim 11, wherein the antistatic agent-containing non-electroconductive filamentary segment (A) has a volume resistivity of $10^8$ to $10^{12}$ Ωcm.

13. The electroconductive conjugate fiber as claimed in claim 11, wherein the antistatic agent comprises at least one member selected from the group consisting of polyoxyethylene group-containing polyethers, and organic sulfonic acid salts.

14. The electroconductive conjugated fiber as claimed in claim 13, wherein the organic sulfonic acid salts for the antistatic agent are selected from the group consisting of alkali metal salts and quaternary phosphonium salts of organic sulfonic acids and mixtures of two or more of the above-mentioned organic sulfonic acid salts.

15. The electroconductive conjugated fiber as claimed in claim 13, wherein the organic sulfonic acid salts are present in an amount of 0.1 to 5.0% by weight of the total weight of the non-electroconductive filamentary sheath segment (A).

16. The electroconductive conjugate fiber as claimed in claim 11, wherein the antistatic agent comprises member polyoxyethylene non-random copolymers of the formula (I):

$$Z[(CH_2CH_2O)_m(R^1O)_nR^2]_k. \quad (I)$$

wherein Z represents a mono to hexa-valent organic residue derived from organic compounds provided with 1 to 6 active hydrogen atoms and having a molecular weight of 300 or less, $R^1$ represents an alkylene group having 6 to 50 carbon atoms, $R^2$ represents a member selected from the group consisting of a hydrogen atom, monovalent hydrocarbon groups having 1 to 40 carbon atoms and monovalent acyl groups having 2 to 40 carbon atoms, k represents an integer of 1 to 6, m represents an integer satisfying a relationship such that the product of k and m is 70 or more, and n represents an integer of 1 or more.

17. The electroconductive conjugated fiber as claimed in claim 16, wherein the copolymers of the formula (I) have an average molecular weight of 5,000 to 16,000.

18. The electroconductive conjugated fiber as claimed in claim 16, wherein the antistatic agent comprising a member selected from the polyoxyethylene non-random copolymers of the formula (I) is contained in the non-electroconductive filamentary segment (A), in a content of 0.5 to 10% by weight, based on the total weight of the non-electroconductive filamentary sheath segment (A).

19. The electroconductive conjugate fibers as claimed in claim 1, wherein the electroconductive filamentary segment (B) is in the form of a core and surrounded by the non-electroconductive filamentary segment (A) in the form of a sheath to form a core-in-sheath conjugate fiber.

20. The electroconductive conjugate fiber as claimed in claim 19, wherein the non-electroconductive filamentary sheath segment (A) contains an antistatic agent and has a volume resistivity of $10^8$ to $10^{12}$ Ωcm.

21. The electroconductive conjugate fiber as claimed in claim 1, wherein in the formula (II), the divalent atoms and groups represented by $R^5$ are selected from the group consisting of —O—, —$CH_2$—, —$CH_2CH_2$—, and $$-\overset{\overset{\displaystyle O}{\|}}{C}-O-.$$

22. The electroconductive conjugate fiber as claimed in claim 1, wherein the silane compound of the formula (II) is selected from the group consisting of vinyl trimethoxysilane, vinyl triethoxysilane, vinyl trichlorosilane, divinyl dimethoxysilane, divinyl diethoxysilane, and divinyl dichlorosilane.

* * * * *